US007596896B2

(12) United States Patent
Crowell et al.

(10) Patent No.: US 7,596,896 B2
(45) Date of Patent: Oct. 6, 2009

(54) THREE-DIMENSIONAL FORMING DISPLAY SYSTEM

(75) Inventors: Christopher S. Crowell, Lyme, CT (US); Joseph R. Klim, New Britain, CT (US)

(73) Assignee: Dimensional Communications, Inc., Chester, CT (US)

( * ) Notice: Subject to any disclaimer, the term of this patent is extended or adjusted under 35 U.S.C. 154(b) by 0 days.

(21) Appl. No.: 12/008,498

(22) Filed: Jan. 10, 2008

(65) Prior Publication Data

US 2008/0178501 A1 Jul. 31, 2008

Related U.S. Application Data

(63) Continuation-in-part of application No. 11/654,469, filed on Jan. 17, 2007.

(60) Provisional application No. 60/764,296, filed on Feb. 1, 2006.

(51) Int. Cl.
*G09F 1/00* (2006.01)

(52) U.S. Cl. ..... 40/124.07; 40/124.08

(58) Field of Classification Search ..... 40/124.07, 40/124.08, 606.12, 720, 738, 743, 761, 771; 248/444.1, 160; 206/769, 776, 778; 428/12; 229/92.8, 71, 117.35

See application file for complete search history.

(56) References Cited

U.S. PATENT DOCUMENTS

| | | | | | |
|---|---|---|---|---|---|
| 1,987,418 | A * | 1/1935 | Plishker et al. | ..... | 40/539 |
| 2,051,467 | A * | 8/1936 | Clark | ..... | 40/539 |
| 3,703,045 | A * | 11/1972 | Nyman | ..... | 40/720 |
| 3,774,332 | A * | 11/1973 | Schneider | ..... | 40/720 |
| 4,854,060 | A * | 8/1989 | Corbo et al. | ..... | 40/720 |

* cited by examiner

*Primary Examiner*—Joanne Silbermann
(74) *Attorney, Agent, or Firm*—Melvin I. Stoltz

(57) ABSTRACT

By providing a unique, pre-formed holding member which is quickly and easily assembled into the three-dimensional diorama display, a unique, visually exciting and interest generating three-dimensional diorama display system is attained. In the preferred embodiment of the present invention, a substantially flat transparent sheet of material is constructed having a desired size and shape for receiving and holding a particular photograph construction or configuration. In addition, the transparent sheet of material incorporates cooperating pre-formed score lines formed along the opposed edges of the transparent sheet, effectively establishing flanges at the opposed side edges thereof. Each of the flanges are arcuately pivoted along the associated score lines, thereby enabling the flanges to extend inwardly, towards each other, establishing two cooperating photograph edge holding flanges.

18 Claims, 9 Drawing Sheets

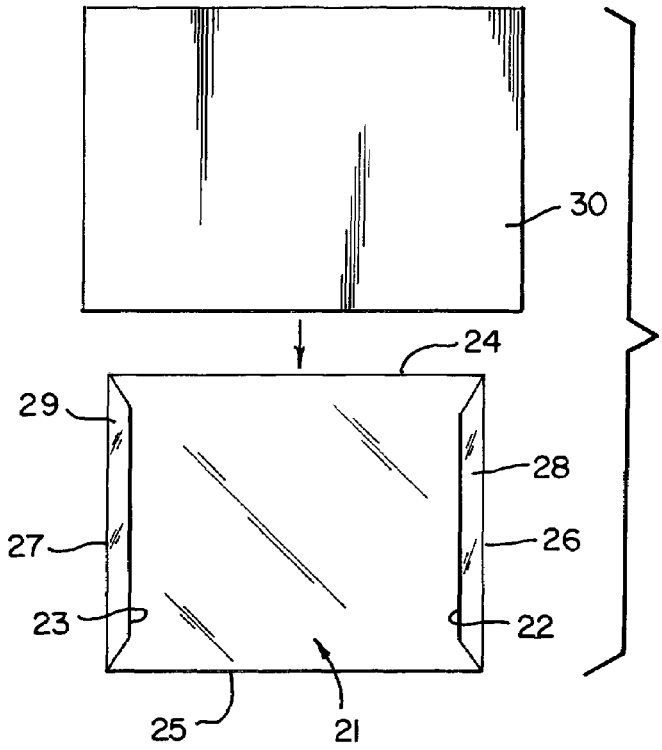
FIG. 4
FIG. 5
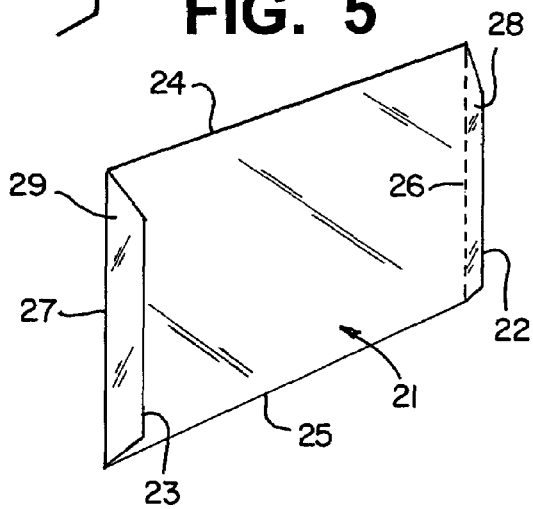
FIG. 6
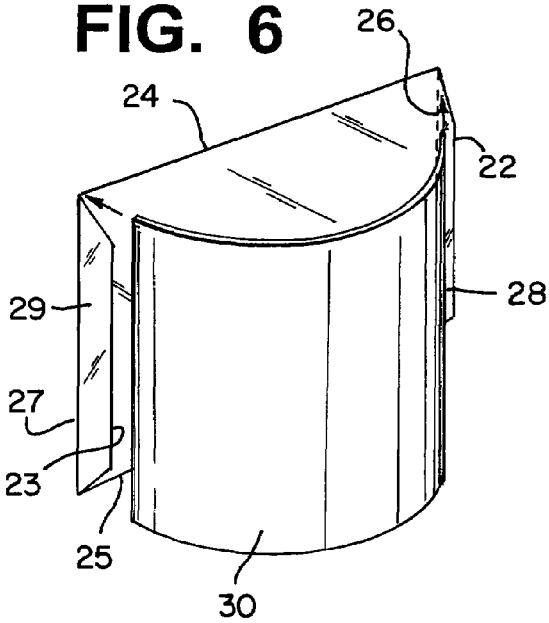

FIG. 11
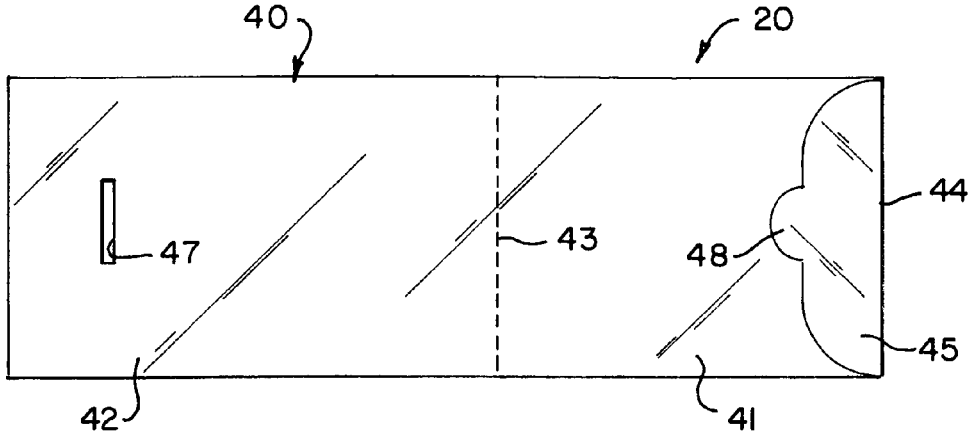
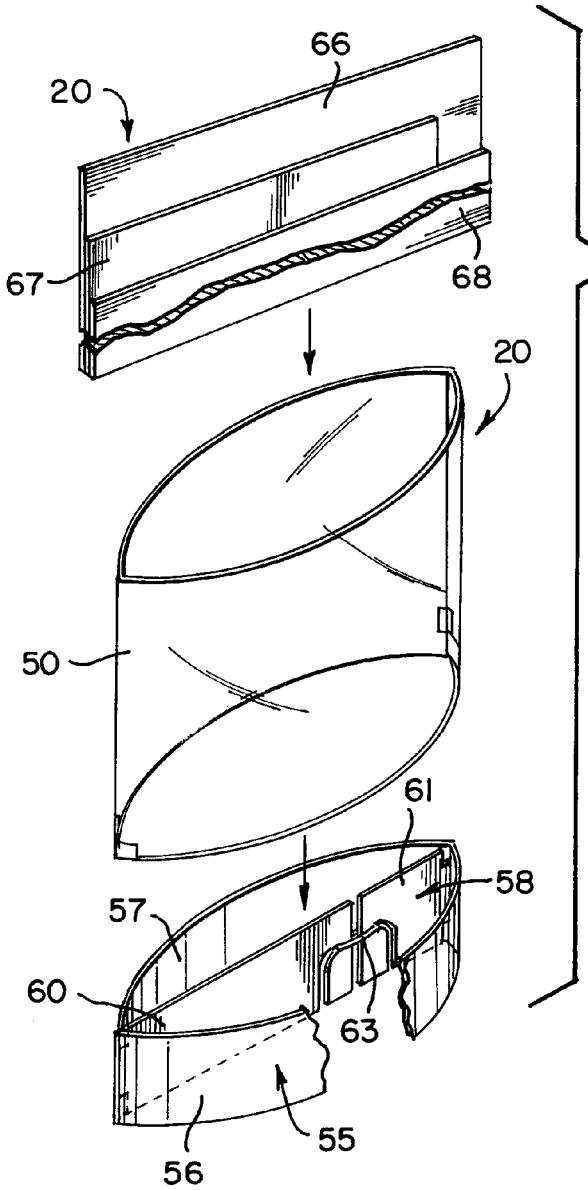
FIG. 12
FIG. 13
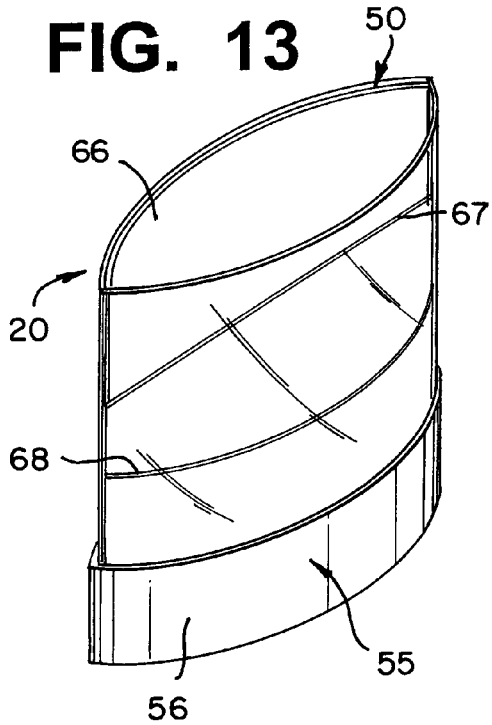

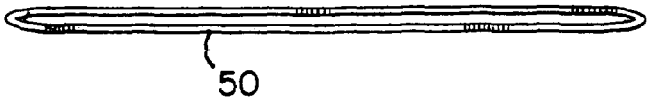
FIG. 14
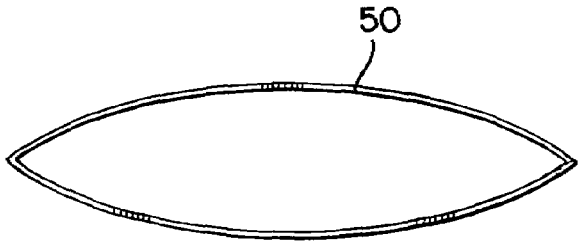
FIG. 15
FIG. 16
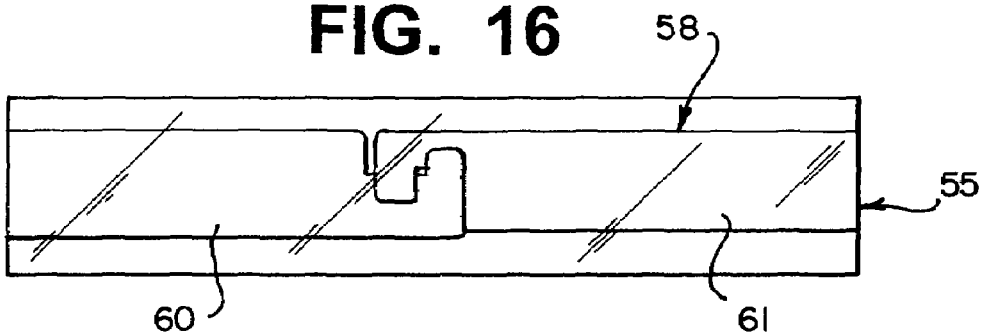
FIG. 17
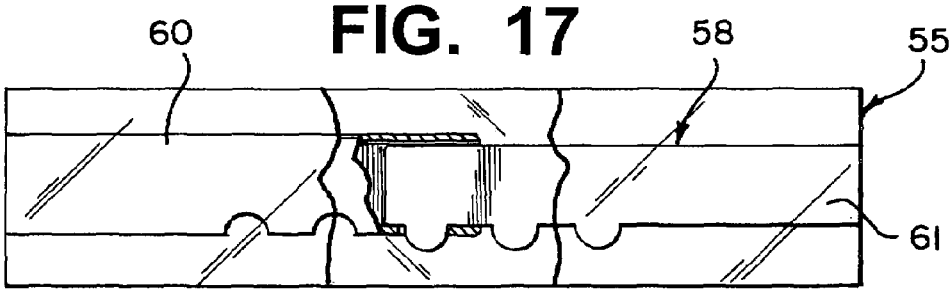
FIG. 18
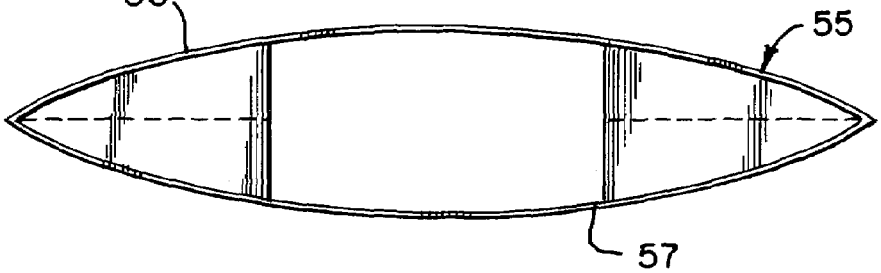

FIG. 19
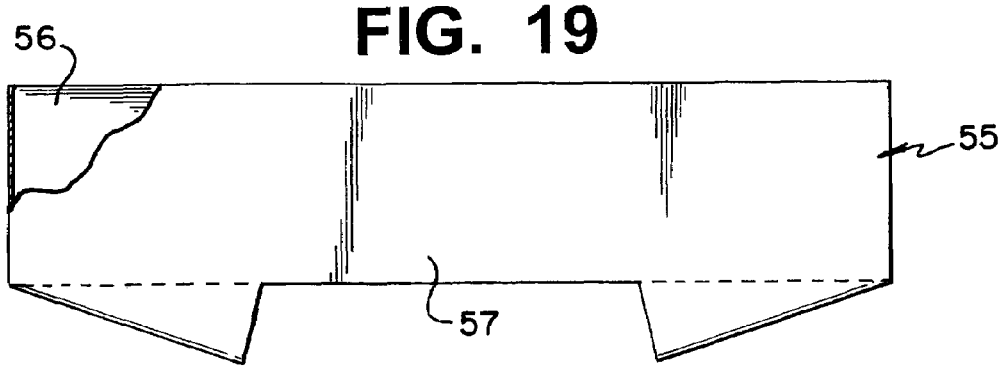
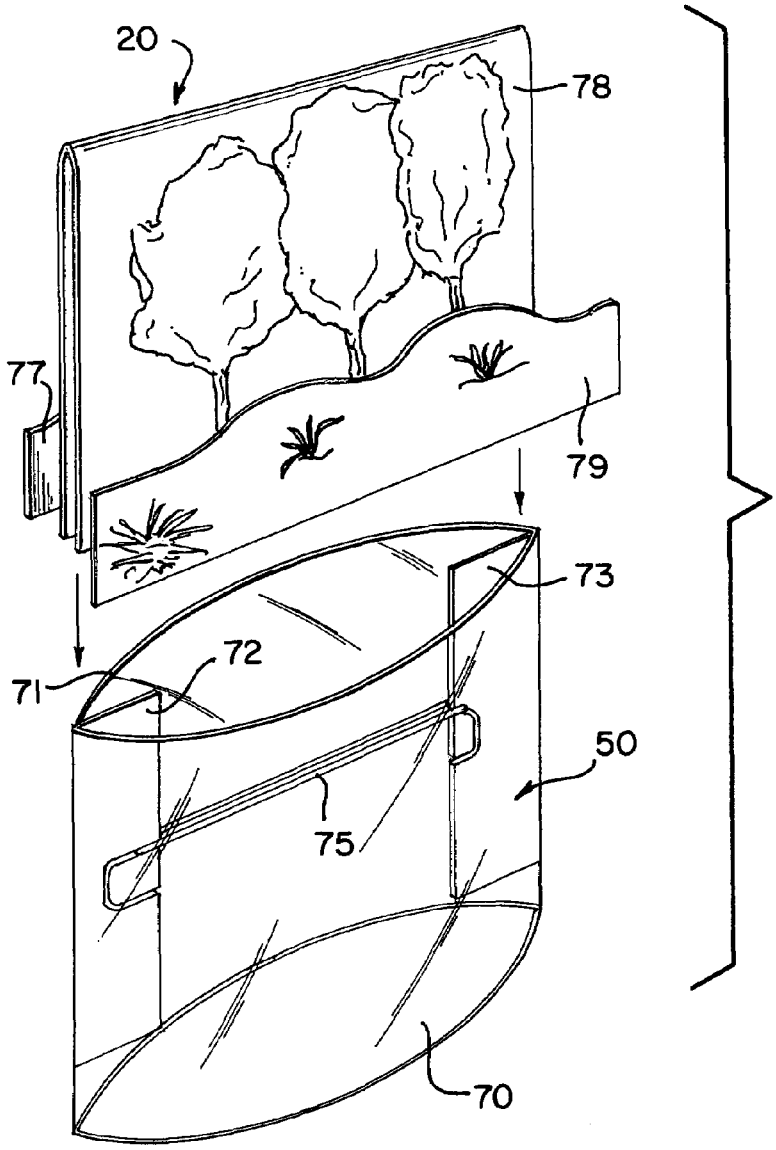
FIG. 20

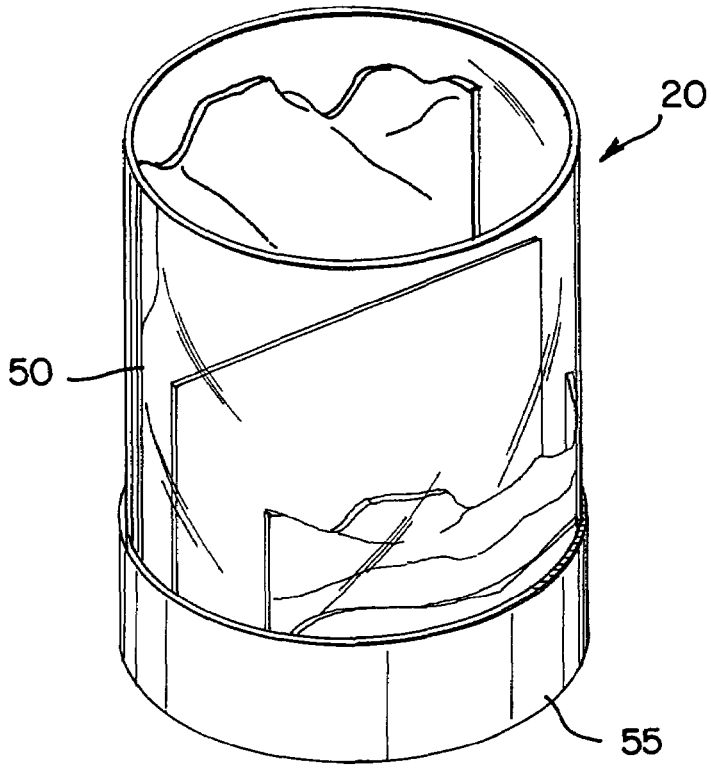
FIG. 28
FIG. 29
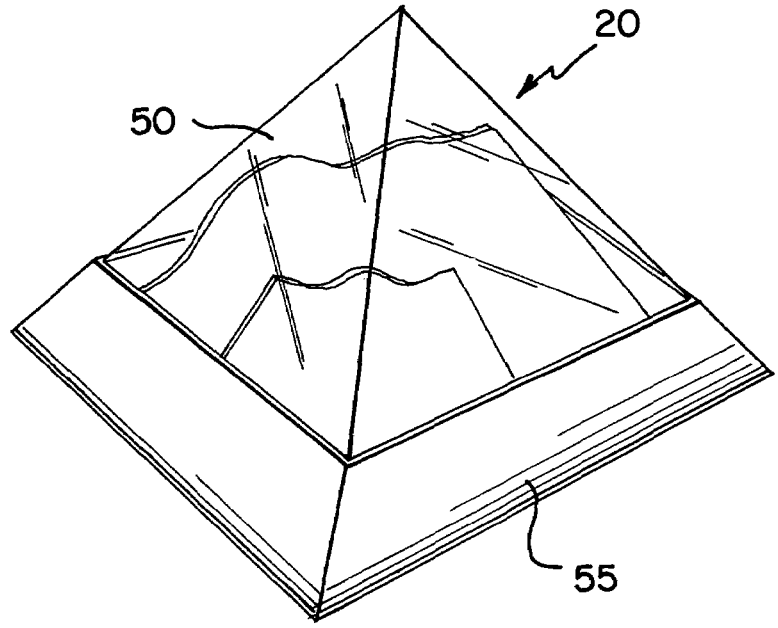

THREE-DIMENSIONAL FORMING DISPLAY SYSTEM

RELATED APPLICATIONS

This application is a Continuation-in-Part application of U.S. Ser. No. 11/654,469 filed Jan. 17, 2007 entitled THREE DIMENSIONAL DIORAMA DISPLAY SYSTEM which is related to U.S. Provisional Patent Application Ser. No. 60/764,296 filed Feb. 1, 2006 entitled THREE DIMENSIONAL DIORAMA DISPLAY SYSTEM.

TECHNICAL FIELD

This invention relates to three-dimensional diorama display systems and, more particularly, to such products which enable the user to create a three dimensional diorama display system from a two-dimensional, substantially flat configuration.

BACKGROUND ART

With the ever increasing and widening interests of consumers and the variety of products which consumers wish to purchase, manufacturers have sought to provide competitive products which will satisfy consumers' interests and desires. In this regard, inexpensive or reasonably priced display systems have long been an area of interest for consumers, particularly those display systems which provide appealing, visually exciting and interest generating images, in particular, display system which are able to employ personal photographs of the consumer.

In an attempt to meet and satisfy consumers' desires, numerous pop-up displays, greeting cards, display cards, and dioramas have been offered for sale in a wide variety of alternate configurations and appearances. However, in spite of the effort expended by many companies to satisfy consumer interests, these prior art products have generally failed to provide the desired interest generating results, in a reasonably priced consumer product. Typically, these prior art products employ complex systems which produce three-dimensional displays when unfolded or erected. However, in spite of some visually unique appearances being generated by such products, the overall cost of production and complexity of assembly for these systems have prevented the systems from becoming popular and/or saleable.

Other prior art display systems have attempted to generate consumer interest by providing unique visual images or other indicia as an integral part of a display. However, these prior art attempts have also failed to generate the interest being sought, largely due to an inability to achieve an easily erected and employable product.

Therefore, it is a principal object of the present invention to provide a visually attractive, interest generating display system which is capable of being produced at a reasonable cost and provides an exciting, visually stimulating display.

Another object of the present invention is to provide a visually attractive, interest generating display system having the characteristic features described above which is in the form of a self-erecting diorama, which is quickly and easily employed by the consumer.

Another object to the present invention is to provide a visually attractive, interest generating diorama display system having the characteristic features described above which is capable of mass production and assembly.

Another object of the present invention is to provide a visually attractive, interest generating diorama display system having the characteristic features described above which provides a unique, eye-catching and exciting display which can be widely varied for satisfying diverse consumer interests.

Another object to the present invention is to provide a visually attractive, interest generating diorama display system having the characteristic features described above which is shippable and transportable in a completely flat configuration, while being quickly erectable, whenever desired, into the three-dimensional visually attractive diorama display.

Another object to the present invention is to provide a visually attractive, interest generating diorama display system having the characteristic features described above which employs personal photographs that are easily mounted as an integral part of the display.

Other and more specific objects will in part be obvious and will in part appear hereinafter.

SUMMARY OF THE INVENTION

By employing the present invention, all of the difficulties and inabilities of the prior art are eliminated and a unique, visually exciting and interest generating three-dimensional diorama display system is attained. These desirable results are achieved in the present invention by providing a unique, pre-formed holding member which is quickly and easily assembled into the three-dimensional diorama display. In addition, the holding member is shipped or stored in a substantially flat configuration in order to reduce storage space. Furthermore, in accordance with the unique aspects of the present invention, the interest generating, three-dimensional/diorama display system of the present invention is quickly and easily fully erected from its flat, generally two-dimensional configuration into a three-dimensional diorama display, possessing all of the attributes desired by consumers.

In accordance with the present invention, a holding member is provided which is constructed for being quickly and easily converted from a two-dimensional, substantially flat configuration into a three-dimensional, fully erect, fully assembled, interest generating, visually exciting diorama displaying position which incorporates any photograph desired by the consumer to be displayed. Although prior art constructions exist for various diorama displays, the present invention provides a unique construction which achieves a quickly and easily constructed three-dimensional diorama display which enables the consumer to display any desired photograph in a unique, interest generating and visually exciting manner.

In accordance with the present invention, a substantially flat transparent sheet of material is constructed having a desired size and shape for receiving and holding a particular photograph construction or configuration. In addition, the transparent sheet of material incorporates cooperating pre-formed score lines formed along the opposed edges of the transparent sheet, effectively establishing flanges at the opposed side edges thereof. Whenever desired by the consumer, each of the flanges are arcuately pivoted along the associated score lines, thereby enabling the flanges to extend inwardly, towards each other, establishing two cooperating photograph edge holding flanges.

Once constructed in this simple, straightforward manner, the holding member of the present invention is ready to receive any desired photograph which the consumer wishes to display. In accordance with the teaching of the present invention, the size and shape of the holding member is designed to enable the photograph to be quickly and easily inserted into the holding engagement with the holding member in a manner which requires the photograph to be arcuately curved and extending rearwardly from the holding member. In this way, a three-dimensional visual effect is achieved.

By constructing the holding member of the present invention in a wide variety of alternate sizes and shapes, all photograph constructions and configurations can be easily accommodated. In this way, each desired photograph can be quickly and easily inserted into an appropriate holding member for achieving a visually distinctive, eye-catching, and interest generating three-dimensional display of the desired photograph.

In order to further enhance the unique, visual display provided by the present invention, various pre-formed, die cut elements may be associated with the holding member. In this regard, preprinted, preformed frame assemblies or die cut, preprinted scene oriented accent strips can be mounted directly on the holding member or in cooperating association with the photograph when secured to the holding member. Regardless of the system employed, these pre-formed, preprinted accent elements can be employed for providing further enhancement to any desired photograph, thereby increasing the interest and visual excitement provided thereby.

In addition, further alternate embodiments of the present invention can also be implemented using a combination of various inserts, die cut elements, panel displays, and support bases for forming and maintaining the holding member in a precisely desired arcuately curved position. In this way, a wide variety of visual appearances can be realized with a resulting display and/or photograph being incorporated into the three dimensional diorama forming display system in a unique, visually exciting, and interest generating manner. Furthermore, using a support base which is constructed for forming and maintaining the transparent panel or holding member in a particular curved or other geometrically shaped pattern, a unique display is realized.

By employing these embodiments of the present invention, an easily manufactured, transparent holding member, typically formed of plastic, can be employed in combination with a solid support base formed from opaque material. In this way, the support base provides a visual contrast to the holding member, while also establishing and providing a specific geometric shape in which the holding member is permanently mounted. As a result, a longer lasting, visually exciting, and interest generating display system is realized.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the present invention, reference should be had to the following detailed description taken in connection with the accompanying drawings, in which:

FIGS. 4-7 are various views of the preformed holding member of FIG. 1 depicting the process of assembly with a photograph being inserted therewith;

FIG. 11 is a rear plan view of an alternate embodiment of the pre-formed holding member of the present invention;

FIG. 12 is an exploded perspective view of a further embodiment of the three-dimensional, diorama forming display system of the present invention depicting the holding member of the present invention in combination with a support base and additional visually distinctive enhancing elements;

FIG. 13 is a perspective view of the three-dimensional diorama forming display system of FIG. 12 depicted fully assembled;

FIG. 14 is a top plan of view of the three-dimensional, diorama forming display system of FIG. 12 shown in its substantially flat, collapsed position;

FIG. 15 is a top plan view of the three-dimensional diorama forming display system of FIG. 12 shown in its fully extended, three-dimensional display position;

FIGS. 16-19 are all perspective views depicting the alternate constructions for the support base of the three-dimensional, diorama forming display system of FIG. 12;

FIG. 20 is an exploded perspective view of a further embodiment of the three-dimensional diorama forming display system of the present invention depicting the holding member of the present invention in combination with visually distinctive enhancing elements;

FIGS. 24-29 are each perspective views of further alternate embodiments and constructions of the three-dimensional diorama forming display system of the present invention.

DETAILED DISCLOSURE

By referring to FIGS. 1-29, along with the following detailed discussion, the construction and operation of several preferred alternate embodiments of the present invention can best be understood. In addition, further alternate embodiments or constructions can be implemented using the teaching of the present invention. Consequently, it is to be understood that the following detailed disclosure and the specific embodiments shown herein, are provided for exemplary purposes only and are not intended as a limitation of the present invention.

Figure 1:
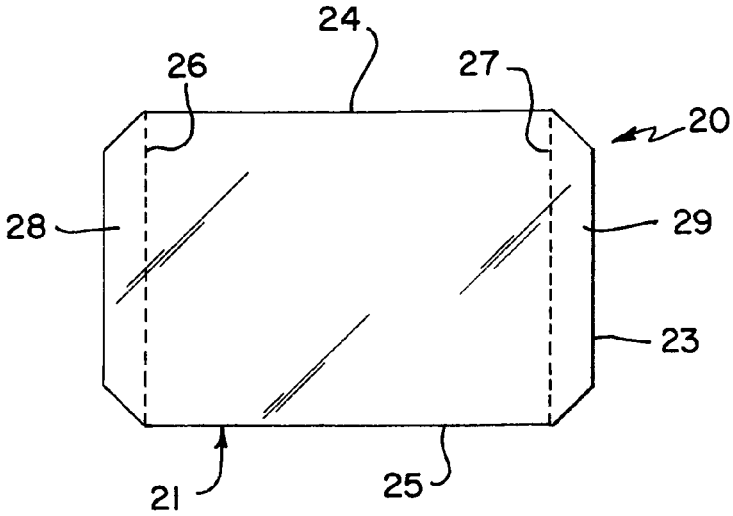
FIG. 1 is a top plan view of the pre-formed holding member of the present invention shown in its substantially flat, two-dimensional position.
Figure 2:
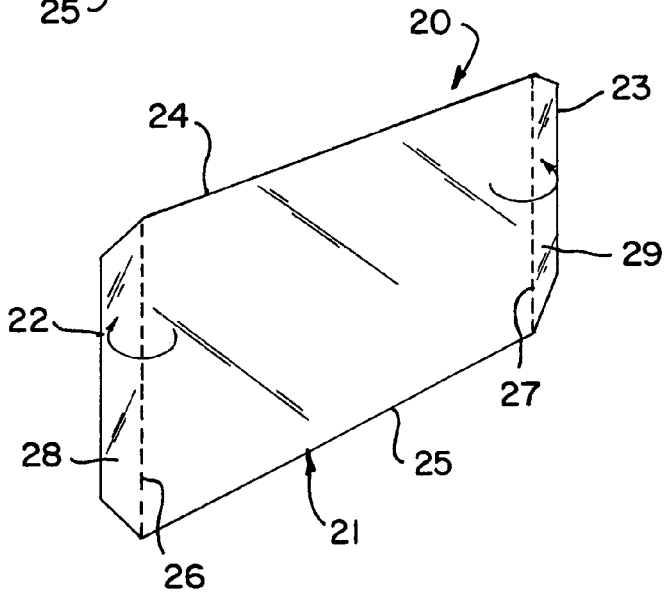
FIG. 2 is a top plan view of the preformed holding member of FIG. 1 shown in the process of being formed into its three-dimensional display position.
Figure 3:
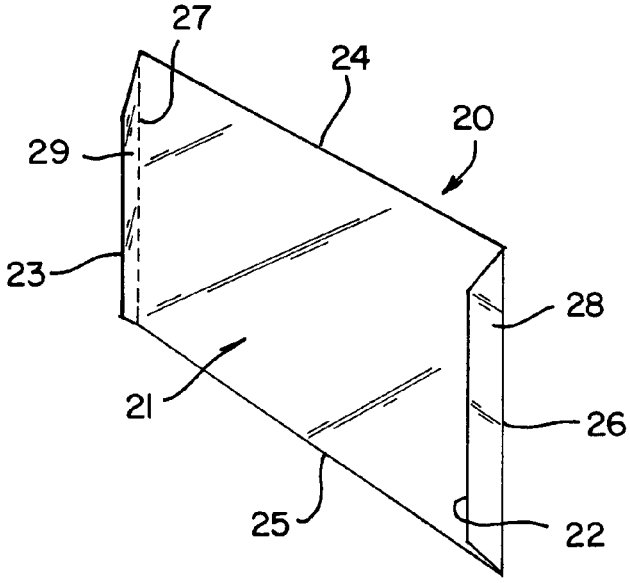
FIG. 3 is a top plan view of the preformed holding member of FIG. 1 shown in its final, three-dimensional display position.

In FIGS. 1-3, picture or photograph holding, three-dimensional/diorama forming display system 20 is fully depicted. As shown, display system 20 comprises panel 21, which is formed from a substantially flat piece of transparent material and comprises side edges 22 and 23, top edge 24, and bottom edge 25. In addition, panel 21 incorporates score lines 26 and 27 which are formed in panel 21, spaced inwardly from side edges 22 and 23. As detailed herein, holding flanges 28 and 29 are formed by score lines 26 and 27, with flanges 28 being formed between side edge 22 and score line 26, while flange 29 is formed between side edge 23 and score line 27.

In FIG. 1, picture/photograph holding, three-dimensional/diorama forming display system 20 is shown in its substantially flat two-dimensional configuration, prior to assembly.

In this position, display system 20 is substantially flat, and is easily stored wherever desired. However, whenever display system 20 is ready to be employed for providing the visually exciting, eye-catching display attainable therewith, display system 20 is removed from any container and the user merely arcuately pivots flange 28 about score line 26. Similarly, flange 29 is arcuately pivoted about score line 27.

When completed, holding flanges 28 and 29 are turned inwardly relative to score lines 26 and 27, positioned as shown in FIG. 3. In this position, side edges 22 and 23 are generally facing each other, with flanges 28 and 29 extending outwardly from the central body of panel 21 and with score lines 26 and 27 forming the side edges of display system 20. In general, flanges 28 and 29 preferably extend from panel 21 at an angle ranging between about 10° and 90°, with 45°being preferred.

Figure 7:
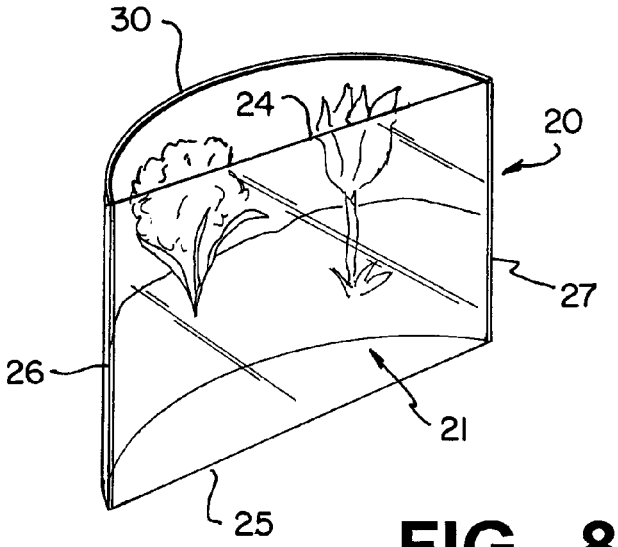

As clearly shown in FIGS. 4-7, once picture/photograph holding, three-dimensional/diorama forming display system 20 has been formed in the desired configuration with flanges 28 and 29 extending inwardly from the body of panel 21, flanges 28 and 29 are capable of being employed for quickly and easily securely retaining the side edges of any picture or photograph. As depicted, any desired photograph 30 is arcuately curved with the side edges thereof being advanced into holding engagement with flanges 28 and 29 and score lines 26 and 27. Once this quick, simple, easily achieved procedure has been implemented, the resulting three-dimensional/diorama forming display system 20 is realized as shown in FIG. 7.

As is evident from the foregoing detailed discussion, picture/photograph holding, three-dimensional/diorama forming display system 20 of the present invention is quickly and easily constructed from its completely flat, two-dimensional configuration into its three-dimensional diorama displaying position. In addition, any desired picture or photograph is quickly and easily inserted into secure holding engagement with display system 20, enabling the photograph or picture to be retained in a continuous, arcuately curved configuration, enabling the picture to be viewable in a unique, eye-catching, interest generating, three-dimensional display. As a result, a simple and inexpensive three-dimensional display system is realized which prior art systems have been incapable of attaining.

Figure 8:
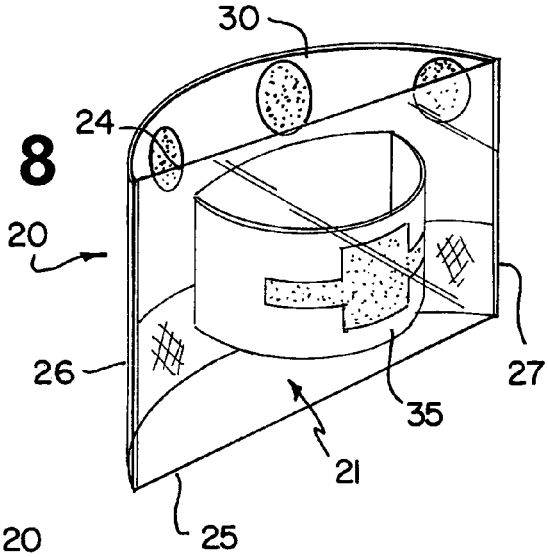
FIGS. 8-10 are perspective views of the preformed holding member of FIG. 1 shown fully assembled with additional enhancing elements cooperatively associated therewith.
Figure 9:
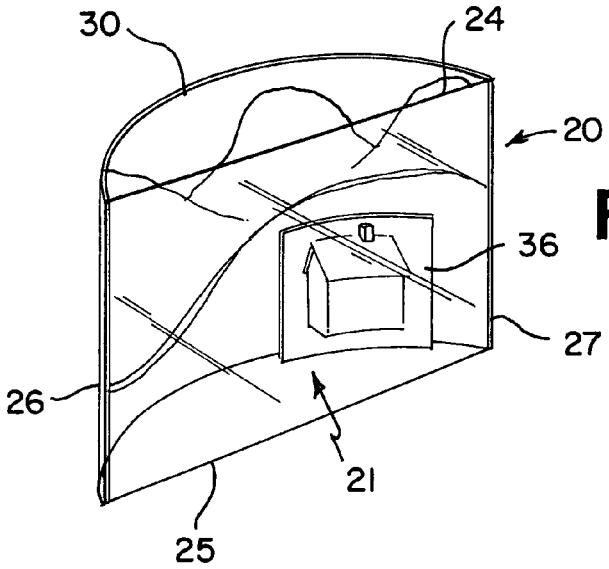
Figure 10:
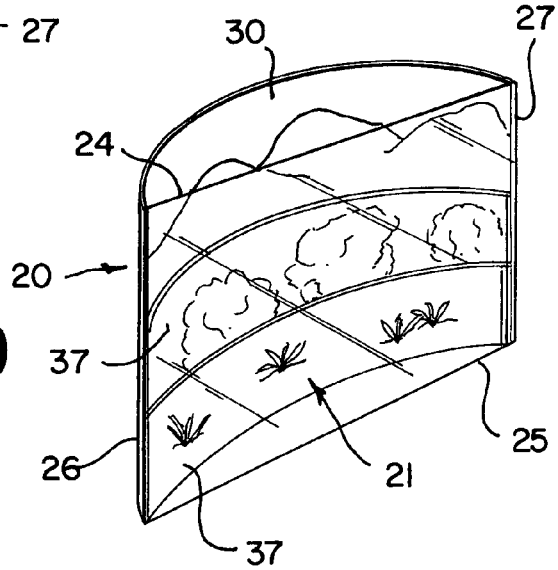
Figure 21:
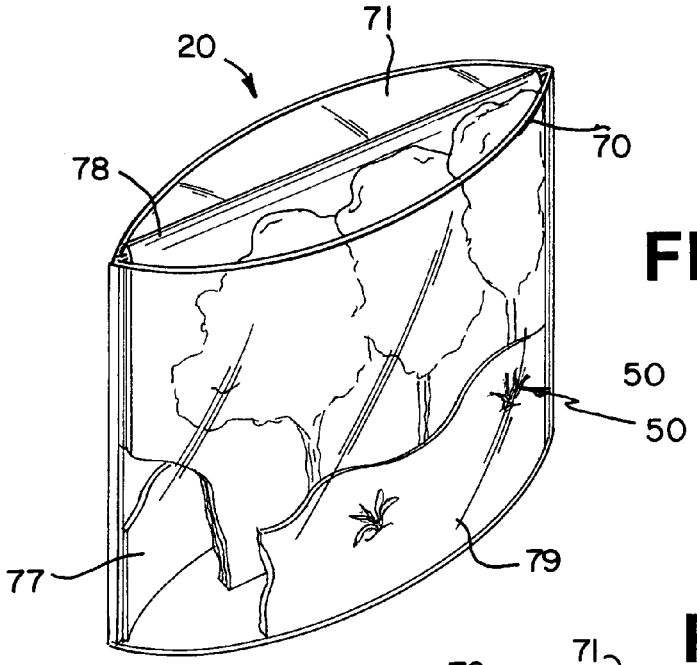
FIG. 21 is a perspective view of the three-dimensional diorama forming display system of FIG. 20 shown fully assembled.
Figure 22:
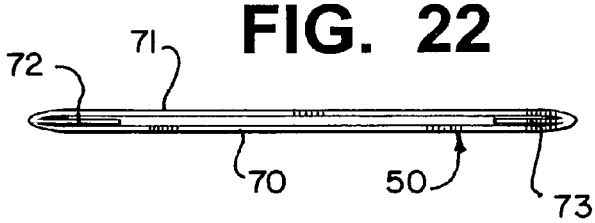
FIG. 22 is a top plan view of the three-dimensional diorama forming display system of FIG. 20 shown in its substantially flat collapsed position.

By referring to FIGS. 8-10, further enhancements or unique distinctive visual add-ons can be employed in order to enhance the eye-catching, visual stimulation attainable by display system 20 of the present invention. As shown therein, for exemplary purposes only, various pre-printed die-cut elements or cut out sections can be added to the photograph or incorporated into the display system in order to provide desired visual enhancements.

In FIG. 8, photograph 30 is shown mounted in display system 20 in its three-dimensional/diorama forming configuration, with cut out portion 35 formed therein and pushed forward of the arcuate curved surface of photograph 30. As a result, portion 35 extends forwardly of the visual information contained on photograph 30, thereby providing a unique and distinctive visual impression.

In FIG. 9, a separate and independent add-on, cutout element 36 is shown positioned between panel 21 and photograph 33. In the embodiment depicted, add-on element 36 is glued to photograph 30. However, element 36 can be affixed to panel 21 or mounted in the open zone formed between the surfaces of photograph 30 and panel 21. Regardless of the configuration employed, virtually any desired unique, distinctive, eye-catching, visual configurations can be implemented and easily attained using these features.

In FIG. 10, photograph 30 is shown mounted in display system 20 in its three-dimensional/diorama forming configuration, with a plurality of additional scene enhancing cutout elements 37 mounted between photograph 30 and panel 21. As depicted, scene enhancing cutout elements 37 extend from score line 26 to score line 27, and are held in position by flanges 28 and 29, similar to the holding engagement of photograph 30. If desired, scene enhancing cut out elements 37 may be affixed to the surface of panel 21, the surface of photograph 30, or maintained in sandwiched interengagement in the manner depicted. Furthermore, if desired, scene enhancing cut out elements 37 may be formed in a peripherally surrounding frame or other configuration for providing any desired background or picture enhancing features to three-dimensional diorama display achieved by the present convention.

In FIG. 11, a further alternate embodiment of picture/photograph holding, three-dimensional/diorama forming display system 20 is depicted. In this embodiment, display system 20 incorporates a single, elongated panel member 40 which is maintained in a substantially flat, two-dimensional configuration prior to assembly.

In the preferred construction, panel member 40 comprises first section 41 and second section 42 which are formed adjacent to each other, separated by score line 43. In addition, panel 40 also incorporates score line 44 which is employed for forming flange 45 and enables flange 45 to be easily moved from a substantially flat configuration into an operational position wherein flange 45 extends outwardly from the surface of section 41. Finally, panel member 40 is preferably constructed from transparent, plastic material having some inherent rigidity, as well as flexibility.

In the preferred construction of this embodiment of the present invention, section 42 of panel member 40 comprises an overall length substantially greater than the overall length of section 41. In addition, receiving slot 47 is formed adjacent to the terminating edge of panel 42 in position for receiving and enabling tab 48 of flange 45 to be inserted and retained therein.

By employing this embodiment of the present invention, display system 20 is quickly and easily erected by arcuately pivoting panel 42 relative to panel 41 along score line 43 and engaging tab 48 in slot 47 of panel 42 in order to retain panel 42 in its curved configuration. Once the assembly is completed, panel 41 remains substantially flat, while panel 42 is arcuately curved extending from score line 43 to flange 44.

Once completely assembled, any desired photograph can be affixed to panel 42 or inserted and retained in display system 20 by placing the edges of the photograph in contact with score lines 43 and 44. In addition, if desired, any visual add-ons or enhancements can also be constructed in the manner detailed above and mounted in panel 40 in association with the photograph for providing further visual interest, excitement, and/or stimulation. In this way, a further unique, distinctive, and easily constructed diorama display system is achieved which is visually attractive and capable of generating interest and excitement.

By referring to FIGS. 12-29, further alternate embodiments and unique, visually distinctive, alternate constructions and configurations of three-dimensional diorama forming display system 20 of the present invention are fully depicted. In each of these embodiments, three-dimensional diorama forming display system 20 comprises panel member 50 which is preferably formed from transparent material. In addition, panel member 50 is formed in a desired hollow geometric shape which essentially establishes the overall construction for display system 20.

Figure 23:
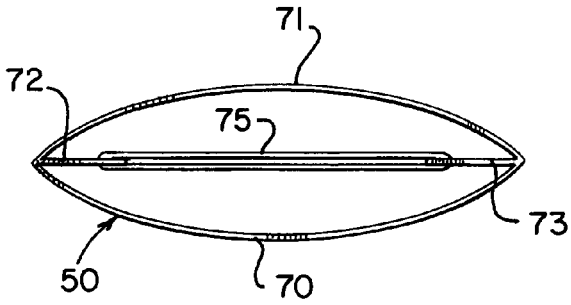
FIG. 23 is a top plan view of the three-dimensional diorama forming display system of FIG. 20 shown in its fully extended, three-dimensional display position.

In the embodiments depicted in FIGS. 12-15 and 20-26, panel member 50 comprises a generally oval or elliptical shape. This shape is desirable and preferred for most display systems manufactured in accordance with the present invention since the oval or elliptical panel member 50 is capable of being folded into a substantially flat configuration for ease of transport, storage, sale, etc. This configuration is clearly depicted in FIGS. 14 and 22. In addition, the oval or elliptical panel member 50 is also quickly and easily moved from a substantially flat configuration into its fully expanded, oval/elliptical display configuration for providing the desired three-dimensional diorama forming display system 20, as shown in FIGS. 16 and 23.

Figure 27:
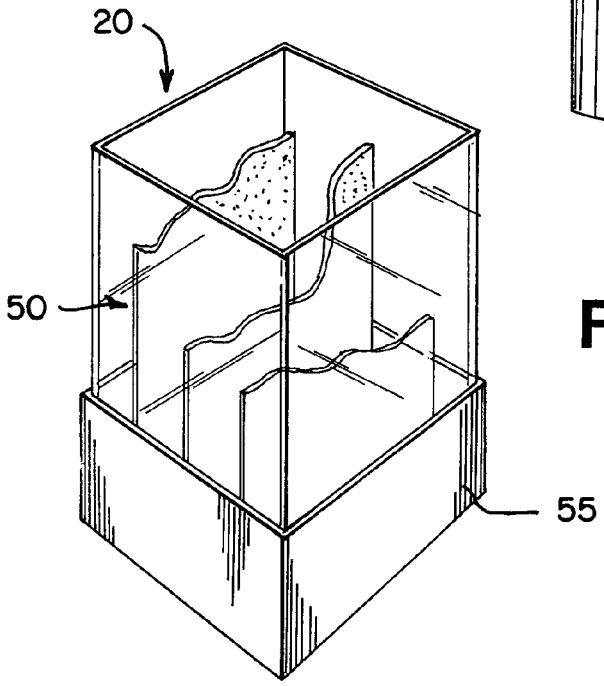

Although the oval/elliptical configuration for panel member 50 is preferred, panel member 50 may also be formed in any other desired geometric shape or configuration. As examples of alternate configurations, three-dimensional diorama forming display system 20 is depicted in FIGS. 27, 28, and 29 in rectangular shapes, circular shapes, and triangular or pyramid shapes. It is to be understood that these figures represent examples of the geometric shapes in which panel member 50 may be formed, with virtually any other desired geometric shape being possible and within the scope of the present invention.

In the preferred construction of each of these alternate embodiments of the present invention, three-dimensional diorama forming display system 20 comprises, in addition to panel member 50, support base 55. By incorporating support base 55 in three-dimensional diorama forming display system 20 of the present invention, several advantages and visually distinctive improvements are realized.

First of all, support base 55 provides a secure, independent structural element on which panel member 50 and all of the associated elements, including any desired photograph, are permanently attached. In addition, support base 55 also provides an enlarged surface on which any desired indicia can be displayed. As a result, messages, communications, advertising information, promotional literature, color displays, preprinted logos, alphanumeric communications, and the like can be easily established and provided. In this way, further visual enhancement of display system 20 is provided.

Furthermore, in the preferred embodiment, support base 55 is also constructed for supporting panel member 50 and maintaining panel member 50 in its fully erect, expanded, three-dimensional display position. In addition, support base 55 is preferably constructed for being permanently affixed with panel member 50 and movable between a substantially flat position and a fully erect position in order to enable display system 20 to be movable between these two alternate positions. In addition, support base 55 is preferably constructed for being self activated, thereby automatically positioning itself in its fully erect display position, while also being responsive to the application of a compression force to move support base 55 from its fully erect position into its substantially flat configuration.

By referring to FIG. 12, along with the following discussion, the construction and operation of one preferred embodiment of support base 55 can best be understood. In this embodiment, support base 55 comprises an arcuately curved front wall member 56 and a cooperating, arcuately curved, rear wall member 57. Preferably, wall members 56 and 57 are affixed to each other at their adjacent terminating ends.

In addition, an interior panel or partition 58 is mounted to wall members 56 and 57 preferably at the juncture of the terminating ends of the wall members with each other. In this way, wall members 56 and 57 along with interior partitions/panel 58 are all securely affixed to each other to form a substantially integral construction.

Finally, in order to provide the desired flexibility or movability of support base 55 between a fully collapsed position and an erect, three-dimensional displaying position, interior partitions/panel 58 is constructed in two separate and independent segments 60 and 61, with segment 60 having its terminating edge positioned adjacent to the terminating edge of segment 61. In addition, segments 60 and 61 are cooperatively interconnected to each other by an elastic band 63 which continuously maintains the terminating edge of segment 60 directly adjacent and associated with the terminating edge of segment 61.

By employing this preferred construction, support base 55 is quickly and easily moved between its two alternate positions, with the fully erect, display position being self activating due to the force provided by elastic band 63. In this regard, elastic band 63 causes the terminating edge of segment 60 to be automatically moved into adjacent relationship with the terminating edge of segment 61 whenever the collapsing force applied to support base 55 is removed. Since the application of a force on wall members 56 and 57 of support base 55 causes support base 55 to be moved into a substantially flat configuration by separating the adjacent edges of segments 60 and 61, the removal of this force causes elastic band 63 to automatically return support base 55 to its original, three-dimensional, display position.

Support base 55, as depicted in FIGS. 12 and 13, represents one preferred construction for implementing a support base which is highly effective for achieving display system 20 of the present invention. However, numerous alternate constructions and configurations for support base 25 can be implemented without departing from the scope of this invention. In this regard, FIGS. 16-19 depict alternate constructions for achieving an effective support base 55 which possesses all of the attributes of the support base 55 of FIGS. 12 and 13.

In the embodiment depicted in FIG. 16, interior partition/panel 58 comprises segment 60 and 61 which incorporate locking fingers formed at the terminating ends thereof to enable the user to manually position support base 55 in its three-dimensional display configuration and manually remove the locked engagement for placing display system 20 in its substantially flat, collapsed configuration. In the embodiment depicted in FIG. 17, segment 60 and 61 comprise locking arms interlocked with each other with a ratchet or locking tooth type configuration being employed for achieving the desired alternate positions. In this construction, manual activation and deactivation would also typically be employed.

In the embodiment depicted in FIGS. 18 and 19, interior partition/panel 58 is eliminated and wall member 56 or wall member 57 is constructed with two cooperating segments, which slidingly nest with each other and are positioned in various alternate extended and collapsed at lengths. If desired, these alternate positions can be achieved automatically, using biasing means, or can be achieved manually.

Regardless of which configuration is employed, it is clear that support base 55 may be constructed in a wide variety of alternate configurations without departing from the scope of the present invention. However, in each of the alternate embodiments, an easily employed, readily constructed support base is realized which is quickly and easily moved between a substantially flat configuration and a fully erect, three-dimensional display configuration wherein diorama forming display system 20 can be rapidly formed and positioned for visual enjoyment.

In the preferred construction of this embodiment of the present invention, a plurality of interior panels are incorporated as an integral component of display system 20. As shown in FIGS. 12 and 14, rear panel 66, middle panel 67, and front panel 68 are preferably incorporated into display system 20. In addition, as shown, each of these panels comprise different dimensions, with rear panel 66 being the largest and front panel 68 being the smallest. In this way, a three-dimensional diorama display effect is achieved.

If desired, panels 66, 67, and 68 can be constructed as the entire diorama display incorporated into display system 20. Alternatively, display system 20 may also be constructed for receiving any desired photograph to be positioned in association with panel 66, 67, and 68, in order to provide a more personalized three-dimensional diorama display. Whichever construction or configuration is desired, the resulting display system 20 achieves a unique, visually exciting, and interested generating product.

By referring to FIGS. 20-23, along with the following detailed discussion, a still further alternate embodiment of three-dimensional, diorama forming display system 20 of the present invention can best be understood. In this embodiment, display system 20 is constructed without a supporting base, and is constructed for providing a three-dimensional diorama display which is viewable from any direction. As a result, display system 20 is constructed for providing a visually distinctive, exciting, interest generating three-dimensional display which is seen and enjoyed whether an individual looks towards the front or towards the rear of display system 20.

In the preferred construction of this embodiment, display system 20 comprises panel member 50 which preferably comprises transparent material and is constructed in a desired geometric shape. As discussed above, although any desired geometric shape can be employed, an oval or ellipse is preferred as depicted in FIGS. 20-23.

Furthermore, this embodiment of panel member 50 comprises front wall 70 and rear wall 71 which are interconnected to each other along their adjacent side edges. In addition, interior plates 72 and 73 are mounted in panel member 50 at the juncture of walls 70 and 71 and extend therefrom inwardly into the interior of panel member 50. By employing interior plates 70 and 71, the desired arcuately curved shape for panel member 50 is established.

As shown in FIG. 20, holding member 75 is mounted to interior plate 72 and extends therefrom for being interconnected with interior plate 73. By dimensioning holding member 75 with a desired overall length, the precise arcuate curvature for front wall 70 and rear wall 71 is established. Furthermore, if desired, holding member 75 may comprise a self activating member for automatically moving panel member 50 into the three-dimensional, display position. Alternatively, holding member 75 may be manually installed for enabling the user to physically move panel member 50 from its flat configuration into its three-dimensional, diorama forming display position.

In order to provide the visual enhancements and interest generating display to diorama forming display system 20, this embodiment of display system 20 comprises three printed interior panels which possess the desired visual information. In this embodiment, interior panels preferably comprise rear panel 77, middle panel 78 and front panel 79.

As with a previous embodiment, each of these panels comprise different dimensions for achieving the desired result. However, in order to achieve a visual display which is viewable from both the front and rear, middle panel 78 comprises the largest panel, while front panel 79 and rear panel 77 are smaller than panel 78. In this way, panels 77 and 78 are viewable from the rear, while panel 79 and 78 are viewable from the front. In addition, if desired, personal photographs can be inserted between panel 78/77 and/or 78/79 in order to personalize the visual display.

As is evident from the foregoing detailed discussion, this embodiment of the present invention provides a further unique display system which is capable of providing enjoyment and interest to the observer. Furthermore, although support base 55 is not employed in the preferred construction, support base 55 can be incorporated into this embodiment, if so desired.

Figure 24:
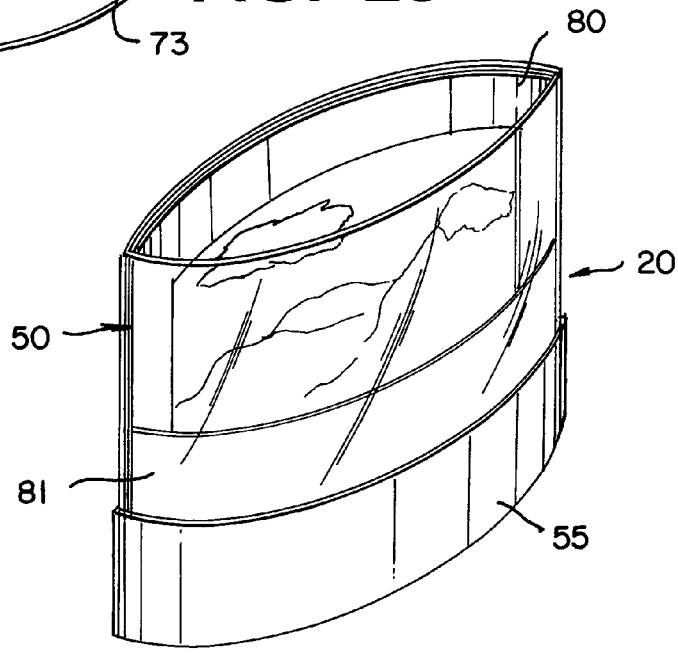
Figure 25:
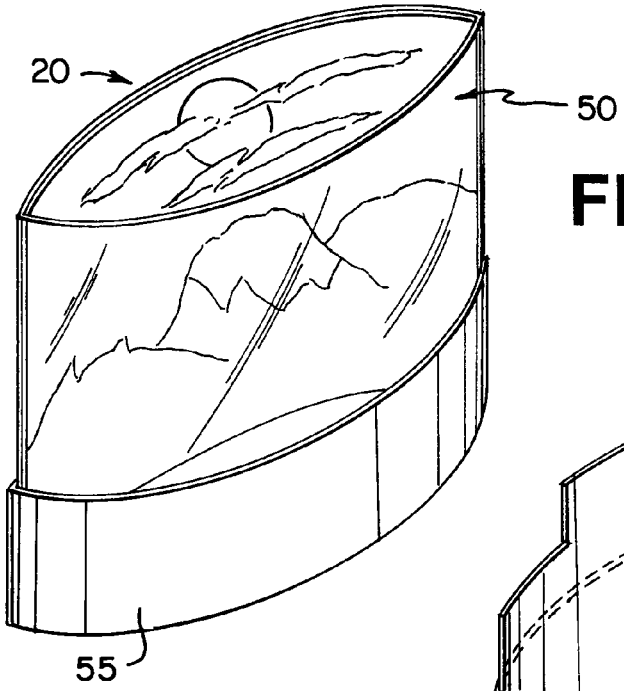
Figure 26:
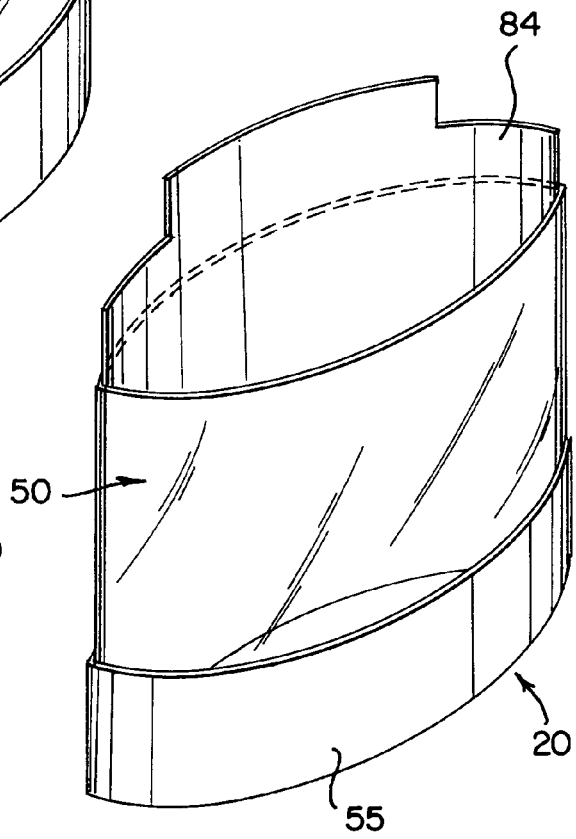

By referring to FIGS. 24, 25, and 26, further alternate variations or embodiments of three-dimensional, diorama forming display system 20 can be seen. In each of these alternate embodiments, display system 20 comprises panel member 50 mounted to support base 55, with each of these components preferably being constructed in the manner detailed above.

In order to fully disclose the versatility of the present convention, FIG. 24 depicts three-dimensional diorama forming display system 20 with interior rear panel 80 mounted in panel member 50 along with front panel 81. By constructing rear panel 80 and front panel 81 with pre-printed indicia, colors, and the like formed thereon, any desired visual appearance can be provided for enhancing diorama display system 20. In addition, as depicted, an individual photograph is preferably mounted and panel member 50 in front of rear panel 80 for integrating a personal element into display system 20. In this regard, if desired, rear panel 80 may comprise a frame structure which peripherally surrounds the photograph inserted therein for emphasizing the photograph and providing a unique visual display for any desired photograph.

In addition, as would be evident to one having ordinary skill in the art, this construction of three-dimensional diorama forming display system 20, as well as each of the alternate embodiments detailed herein, may be formed in any desired size. As a result, displays ranging from small, business card sizes to large photograph format sizes may be constructed and employed using the teaching of the present invention.

In FIG. 25, display system 20 is depicted incorporating panel member 50 and support base 55 along with any desired photograph mounted therein. In this embodiment, a basic construction is achieved for providing a unique display for any desired important or memorable photograph. Although additional enhancements as detailed above could be incorporated into this structure, FIG. 25 depicts display system 20 as a single three-dimensional diorama display for a single photograph.

Finally, FIG. 26 depicts a further embodiment of the present invention wherein display system 20 incorporates panel member 50, mounted to support base 55. In this embodiment, a unique visually distinctive and interest generating display panel 84 is mounted in panel member 50 extending outwardly from the top edge thereof. In this way, greater visual distinction and enhancement is provided to display system 20. In this regard, if desired, display panel 84 may extend from the top edge of panel member 50 to base 55 in order to provide an interior visual display therefore or, alternately, may be constructed with a cutout zone for enabling additional interior pre-printed display panels to be mounted in panel member 50 for providing further interest, excitement, and enhancements to display system 20.

As is evident from the foregoing detailed discussion, a uniquely constructed, simple and inexpensive three-dimensional/diorama forming display system is attained by employing the teaching of this invention. As shown and discussed, any desired photograph can be quickly and easily substantially enhanced for producing a unique, visually distinctive eye-catching three-dimensional/diorama display which has previously been unattainable with any prior art system. Furthermore, by employing any of the unique add-ons or enhancements detailed above, further visually distinctive features are realized.

It will thus be seen that the objects set forth above, among those made apparent from the preceding description, are efficiently attained and, since certain changes may be made in the above article without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim is new and desire to secure by Letters Patent is:

1. A display system for providing an attractive and interest generating visual display comprising:

A. a holding member constructed for maintaining any desired display elements in an arcuately curved, diorama display configuration, said holding member comprising:
   a. a first, elongated, substantially flat, rectangular shaped transparent sheet of material having a top edge, a bottom edge, and two side edges;
   b. a second, elongated, substantially flat, rectangular shaped transparent sheet of material having a top edge, a bottom edge, and two side edges;
   c. said first transparent sheet of material and said second transparent sheet of material being cooperatively associated with each other in juxtaposed, spaced alignment, with the side edges of the first transparent sheet of material being affixed to the adjacent side edges of the second transparent sheet of material, thereby forming a generally oval or elliptically shaped holding member which is movable between a first, substantially flat configuration and a second, expanded three-dimensional display position;

B. a support base
   a. constructed for being mounted in engagement with the lower edge of the first and second elongated rectangular shaped transparent sheets of material,
   b. comprising two arcuately curved wall members mounted in cooperating association with each other and a third, interior support wall incorporating two separate and independent segments aligned with each other and interconnected by biasing means for enabling the segments to be movable relative to each other, and
   c. constructed for being movable between a first substantially flat configuration and a second, expanded, three-dimensional display position in association with the movement of the holding member; and C. at least one pre-printed enhancing element constructed for being mounted within the holding member for providing further visual enhancement to the three-dimensional display provided thereby.

2. The display system defined in claim 1, wherein the support base is further defined as being constructed for being normally maintained in its second, three-dimensional display position due to the incorporation of the biasing means which provides self-activating means for moving the support base from its first, substantially flat configuration into its second, three-dimensional display position.

3. A display system for providing an attractive and interest generating visual display comprising:

A. a holding member constructed for maintaining any desired display elements in an arcuately curved, diorama display configuration, said holding member comprising
   a. a first substantially flat rectangular shaped sheet of material incorporating a transparent portion and having a top edge, a bottom edge, a first side edge, and a second side edge;
   b. a second substantially flat, rectangular shaped sheet of material incorporating a transparent portion and having a top edge, a bottom edge, a third side edge, and a fourth side edge;
   c. said first sheet of material and said second sheet of material being cooperatively associated with each other in juxtaposed, spaced alignment, with the first side edge of the first sheet of material being affixed to the third side edge of the second sheet of material, while the second side edge of the first sheet of material is affixed to the fourth side edge of the second sheet of material, thereby forming a holding member which is movable between a first, substantially flat configuration and a second, expanded, generally oval or elliptically shaped, three-dimensional display configuration;

B. a support base constructed for being mounted in engagement with the bottom edge of the first sheet of material and the bottom edge of the second sheet of material, and constructed for being movable between a first substantially flat configuration and a second, expanded, three-dimensional display configuration in association with the movement of the holding member, said support base comprising
   a. a first panel member having a first side edge and a second side edge,
   b. a second panel member having a third side edge and a fourth side edge,
   c. said first panel member and said second panel member being cooperatively associated with each other in juxtaposed, spaced, cooperating relationship, with the first side edge of the first panel member being affixed to the third side edge of the second panel member, while the second side edge of the first panel member is affixed to the fourth side edge of the second panel member;

C. a first pre-printed enhancing element constructed for being mounted within the holding member for providing further visual enhancement to the three-dimensional display provided thereby; and D. control means mounted in the support base and constructed for controlling the movement of the support base and the holding member between their first, substantially flat configurations and their second, expanded, generally oval or elliptically shaped, three-dimensional display configurations, said control means being further defined as comprising
   a. a first arm member mounted at one end thereof between the first side edge of the first panel member and the third side edge of the second panel member, and extending from said mounted position inwardly between the first panel member and the second panel member,
   b. a second arm member mounted at one end thereof between the second side edge of the first panel member and the fourth side edge of the second panel member, and extending from said mounted position inwardly between the first panel member and the second panel member towards said first arm member, and constructed for cooperating with said first arm member for enabling the support base to be controllably moved from its first, substantially flat configuration into its second, expanded, generally oval or elliptically shaped, three-dimensional configuration.

4. The display system defined in claim 3, wherein said first arm member and said second arm member are further defined as being interconnected by biasing means for enabling the arm members to be movable relative to each other, while also enabling an external force to cause the display system to move from its second, three-dimensional configuration into its first, substantially flat configuration, while also enabling the display system to automatically return to its second, three-dimensional display configuration whenever said force is removed, due to the activation of the biasing means.

5. The display system defined in claim 3, wherein said first arm member and said second arm member are constructed for cooperative engagement with each other, enabling a plurality of alternate positions to be selected, for causing the display system to be movable into a plurality of alternate three-dimensional configurations.

6. The display system defined in claim 5, wherein said first arm member incorporates a plurality of notches formed along the length thereof and said second arm member incorporates a notch engaging portion formed therein, whereby said second arm member is engagable in the plurality of alternate notches formed in the first arm member for enabling said display system to be movable into a plurality of alternate three-dimensional configurations.

7. The display system defined in claim 5, wherein said first arm member and said second arm member are constructed for sliding engagement with each other, thereby enabling a plurality of alternate positions to be selectively established.

8. The display system defined in claim 3, wherein said holding member is further defined as comprising a single, elongated substantially flat, rectangular shaped transparent sheet of material incorporating a fold line formed therein substantially midway along its length, thereby effectively creating said first rectangular shaped transparent sheet of material and said second substantially flat rectangular shaped sheet of material in a single, substantially continuous, elongated component.

9. The display system defined in claim 3, wherein the first pre-printed enhancing element is further defined as comprising indicia printed on both sides thereof, thereby enabling said enhancing element to be viewable through both the first sheet of material and the second sheet of material.

10. The display system defined in claim 3, wherein said system further comprises a second pre-printed enhancing element positioned in the holding member between the first sheet of material and the first enhancing element for providing additional visual excitement and interest to said display system.

11. The display system defined in claim 10, wherein said second preprinted enhancing element comprises a vertical height which is equivalent to less than 30% of the vertical height of the first enhancing element.

12. The display system defined in claim 10, wherein said first enhancing element and said second enhancing element comprise indicia formed thereon, and said indicia comprises one or more selected from the group consisting of pictures, alphanumeric elements, colors, logos, contours, and cutouts.

13. A display system for providing an attractive and interest generating visual display comprising:

A. a holding member constructed for maintaining any desired display elements in an arcuately curved, diorama display configuration, said holding member comprising:
   a. a first, substantially flat, rectangular shaped sheet of material incorporating a transparent portion and having a top edge, a bottom edge, and two side edges;
   b. a second, substantially flat, rectangular shaped sheet of material incorporating a transparent portion and having a top edge, a bottom edge, and two side edges;
   c. said first sheet of material and said second sheet of material being cooperatively associated with each other in juxtaposed, spaced alignment, with the side edges of the first sheet of material being affixed to the adjacent side edges of the second sheet of material, thereby forming a generally oval or elliptically shaped holding member which is movable between a first, substantially flat configuration and a second, expanded three-dimensional display position;

B. a support base
   a. constructed for being mounted in engagement with the lower edge of the first and second elongated rectangular shaped sheets of material, and
   b. constructed for being movable between a first substantially flat configuration and a second, expanded, three-dimensional display position in association with the movement of the holding member; and C. at least one pre-printed enhancing element constructed for being mounted within the holding member between the first sheet of material and positioned for being viewable through the transparent portions of the first and second sheets of material, and providing further visual enhancement to the three-dimensional display provided thereby.

14. The display system defined in claim 13, further comprising control means mounted in the support base for controlling the movement of the supporting base and the holding member between their first substantially flat configuration and their second, expanded, generally oval or elliptical shaped, three dimensional configuration.

15. The display system defined in claim 13, wherein the first pre-printed enhancing element is further defined as comprising indicia printed on both sides thereof, enabling said enhancing element to be viewable through the transparent portion of both the first sheet of material and the second sheet of material.

16. The display system defined in claim 13, wherein said system further comprises a second pre-printed enhancing element positioned in the holding member between the first sheet of material and the first enhancing element for providing additional visual excitement and interest to said display system.

17. The display system defined in claim 16, wherein said second preprinted enhancing element comprises a vertical height which is equivalent to less than 30% of the vertical height of the first enhancing element.

18. The display system defined in claim 16, wherein said first enhancing element and said second enhancing element comprise indicia formed thereon, and said indicia comprises one or more selected from the group consisting of pictures, alphanumeric elements, colors, logos, contours, and cutouts.

* * * * *